United States Patent [19]

Tsuji

[11] Patent Number: 4,570,869

[45] Date of Patent: Feb. 18, 1986

[54] SPOOL FOR RIBBONS, TAPES, ETC.

[75] Inventor: Shintaro Tsuji, Tokyo, Japan

[73] Assignee: Sanrio Company, Ltd., Tokyo, Japan

[21] Appl. No.: 649,224

[22] Filed: Sep. 10, 1984

[30] Foreign Application Priority Data

Jan. 4, 1983 [JP] Japan ..... 58-171062

[51] Int. Cl.[3] ..... B65H 75/18

[52] U.S. Cl. ..... 242/71.9; 242/118.5

[58] Field of Search ..... 242/71.8, 71.9, 77.3, 242/118.4, 118.5, 118.7, 118.8, 115, 116; 474/8

[56] References Cited

U.S. PATENT DOCUMENTS

| | | | |
|---|---|---|---|
| 2,406,434 | 8/1946 | Payne | 242/118.5 |
| 2,518,533 | 8/1950 | Edwards | 242/116 |
| 2,905,408 | 9/1959 | Frate et al. | 242/118.5 |
| 4,193,560 | 3/1980 | Diegel | 242/71.9 |
| 4,428,546 | 1/1984 | Weideman | 242/118.5 |

*Primary Examiner*—Leonard D. Christian

*Attorney, Agent, or Firm*—Owen, Wickersham & Erickson

[57] ABSTRACT

This spool for ribbons, tapes, string, and the like comprises a plastic first cylinder, which ribbons or tapes are coiled around. A projecting flange along one edge of the cylinder helps to hold the ribbons or tapes coiled around it. Fitted inside the first cylinder is an adjustable second cylinder made of the same material. This adjustable second cylinder provides a second flange and includes a series of openings, each having a series of steps, any one of which can engage a projection rib on the inner surface of the first cylinder. The width between the two flanges is thereby determined, and the two cylinders may then be secured in the selected position.

8 Claims, 5 Drawing Figures

SPOOL FOR RIBBONS, TAPES, ETC.

This invention relates to a spool on which ribbons are wound, the spool being adjustable to accommodate different widths of ribbons.

BACKGROUND OF THE INVENTION

This device relates to a spool around which ribbons, tapes, or strings are coiled.

The spool may be used for winding any type of ribbon, tape, or string. It is especially useful for holding gift-wrapping ribbons.

The problem has been that different widths of ribbons and tapes have required different spools, so that several different widths of spools were required to accommodate the different ribbon and tape widths.

Basically, ribbon spools comprise a central cylinder between two flanges. When the flanges are closer together than the width of the ribbon, the central cylinder cannot take the ribbon. When the flanges are too far apart, it is difficult to retain the ribbon properly.

An object of the present invention is to provide a simple two-piece spool that can accommodate any of a series of different ribbon or tape widths.

Another object of the invention is to provide a spool which tapes in various widths can be neatly coiled around without having to manufacture many spools for different widths.

Another object is to provide spools of various capacities for wound string, the capacities being readily adjustable from identical components.

Another object is to provide a ribbon spool that assists the manufacturer in production and the consumer in his use.

SUMMARY OF THE INVENTION

This spool for ribbons, tapes, and the like comprises a plastic first cylinder, which ribbons or tapes or string are coiled around. A projecting flange along one edge of the cylinder helps to hold ribbons, tapes, or string coiled around the cylinder. Fitted inside the first cylinder is an adjustable second cylinder made of the same material. This adjustable second cylinder also has a ribbon-retaining flange and includes a series of openings which engage projecting transverse ribs formed on the inner surface of the first cylinder. The opening comprises multiple steps in a stair-like form, with which the end of the transverse rib makes contact. Which step is used depends on the width of the ribbon to be used. Once the proper width is determined, the two cylinders are accordingly assembled, and they may be held in their assembled relation by sticky tape or by cement.

DESCRIPTION OF A PREFERRED EMBODIMENT

Figure 1:
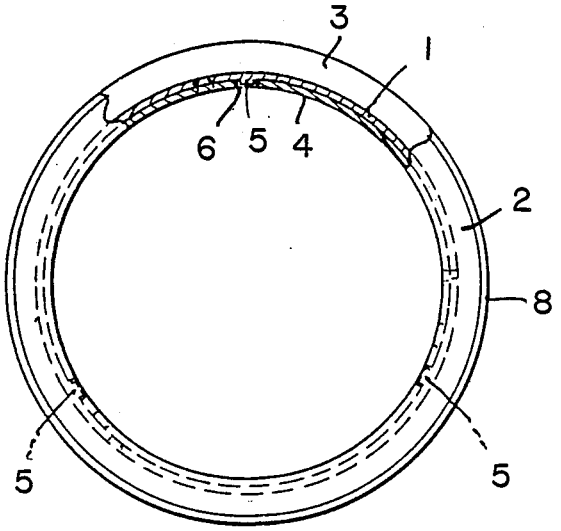
FIG. 1 is a view in side elevation of a spool embodying the principles of the invention. A portion of the top is broken away and shown in section.
Figure 2:
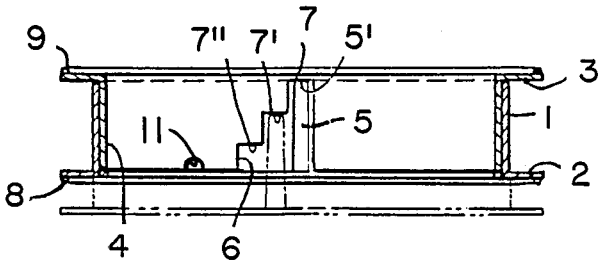
FIG. 2 is a view in section taken across FIG. 1, with the two spool portions in their most compact assembled position, to accommodate the narrowest ribbons.

To achieve the above described objects this device is constructed as follows:

This spool for ribbons, tapes and the like comprises a plastic first cylinder 1 which ribbons or tapes are coiled around, with a projecting flange 2 along the outer edge of the cylinder 1. A second flange 3 helps hold the ribbons or tapes coiled around the cylinder 1. This flange 3 is provided by an adjustable second cylinder 4 made of same material and fitted inside the cylinder 1. The cylinder 4 has a series of openings 6 which engage a raised transverse rib 5 of the first cylinder 1. The rib 5 is transverse to and on the inside surface of the cylinder 1. Each opening 6 has a series of multiple steps 7, 7' or 7'' in a stair-like form with which the tip 5' of the raised rib 5 makes contact. There may be more steps, if desired. In the attached drawings each flange 2, 3 has an outwardly projecting reinforcing ring 8 or 9 integral with the flange to reinforce it and lying on the axially outer surface thereof near its outer circumference. In the drawings, there are three raised ribs 5 and three openings 6, at equal spacing.

The cylinder 1 is preferably provided with a series (e.g., three) transverse slots 10, to provide additional flexibility for tolerances and size allowance.

Also, both cylinders 1 and 4 are preferably provided with edge indentations 11 that may be semi-circular and that help in removing the device from the mold, for ejectors can engage these indentations 11 to push the cylinders 1 and 4 out of the mold without causing rough spots on the cylinders. Because of this function they may be called "smoother points". There may be three or four of these, evenly spaced apart.

Figure 3:
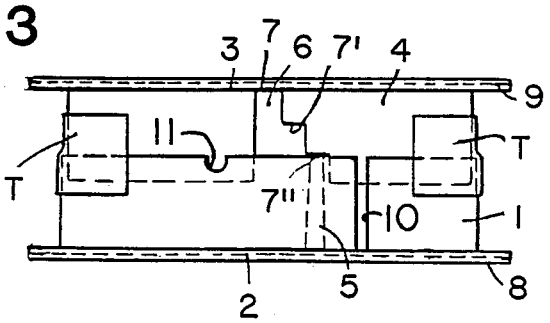
FIG. 3 is a view of the spool assembly looking down from above, with the two components spread apart to one of their wider positions.
Figure 4:
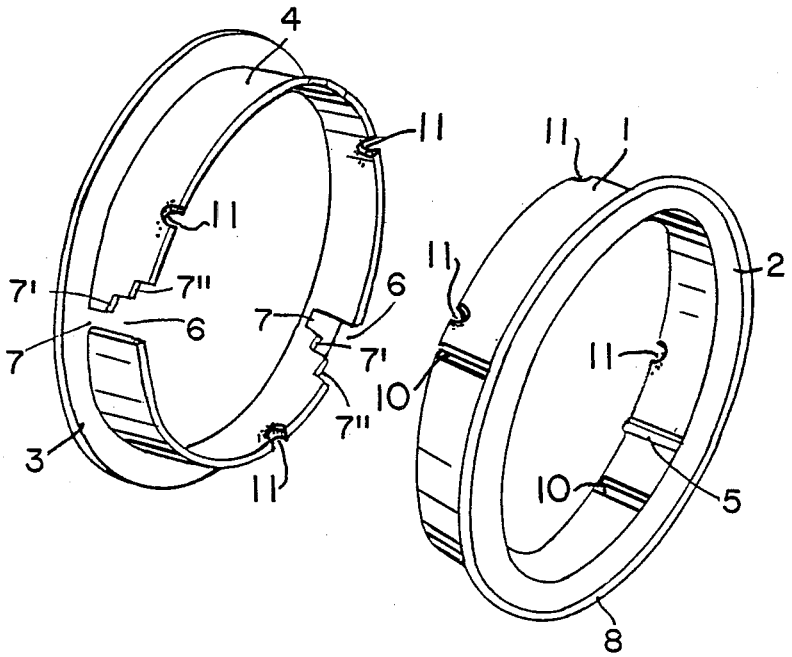
FIG. 4 is an exploded view in perspective of the spool assembly, showing the two elements.
Figure 5:
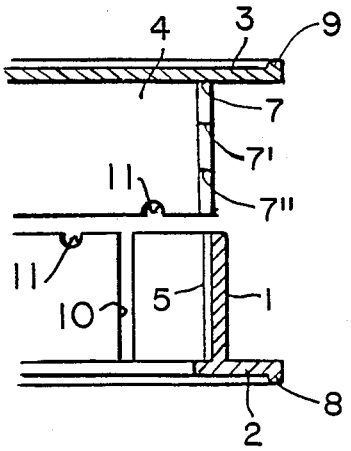
FIG. 5 is a fragmentary enlarged view in section of a portion of the two elements, shown apart from each other.

Because this device is constructed as described above, the tip 5' of the raised rib 5 can engage any one of the steps 7, 7' or 7'', whichever one is suitable. Then the first cylinder 1 and the adjustable second cylinder 4 may be bonded together as by cement or, preferably, by using short strips T of pressure-sensitive adhesive tape (see FIG. 3). The distance between the two flanges 2 and 3 can readily be adjusted before the tape T is applied and depends on the engaging position of the rib 5 with a selected step 7, 7', or 7'' etc. This makes it possible to use this device for any width of ribbon. In other words, one pair of cylinders 1 and 4, which can be made from one metal mold, can be used to provide a series of different widths for tapes to be coiled around the assembly. This makes the produce very economical.

Furthermore, for things like thin strings which do not require any particular width, the volume of the string coil can be adjusted by changing the width of the space between the two flanges 2 and 3.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A spool for ribbons, tapes, string and the like, comprising a plastic first cylinder having an outer cylindrical surface around which ribbon, or tape, or string may be coiled, an inner surface, and a projecting first flange along one edge, said inner surface having a series of identical transverse ribs projecting inwardly therefrom, and an adjustable plastic second cylinder having a second flange along one edge and a series of identical openings extending in from the other edge, each opening providing a series of steps in a stair-like form, with one of which one end of a transverse rib makes contact, the selection of which steps are engaged by the ribs determining the width between the two flanges of the assembled spool.

2. The spool of claim 1 having three said openings spaced 120° apart and three said ribs spaced 120° apart.

3. The spool of claim 1 wherein each said flange has a circular strengthening reinforcing ring on an axially outer surface thereof near the outer end of the flange.

4. The spool of claim 1 wherein said first cylinder is provided with a series of transverse through slots across its cylindrical surface.

5. The spool of claim 1 wherein each of said cylinders has a series of indentations on the edge opposite its said flange.

6. A spool for ribbons, tapes, string and the like, comprising a plastic first cylinder having an outer cylindrical surface around which ribbon, or tape, or string may be coiled, an inner surface, and a projecting first flange along one edge, said inner surface having a series of evenly spaced-apart identical transverse ribs projecting inwardly therefrom, an adjustable second cylinder having a second flange along one edge and a series of evenly spaced-apart identical openings extending in from the other edge, one for each said rib, each opening providing along one transverse side a series of steps in a stair-like form, with one of which one end of a transverse rib makes contact, the selection of which steps are engaged by the ribs determining the width between the two flanges of the assembled spool, and securing means for holding said second cylinders in a selected position.

7. The spool of claim 6 having, across the cylindrical portion of said first cylinder, three evenly spaced apart transverse slots imparting flexibility.

8. The spool of claim 6 wherein both cylinders have, along the edge opposite their flanges, a series of at least three evenly spaced apart semicircular indentations to serve as smoother points.

* * * * *